US007670051B2

(12) United States Patent
Chaturvedi

(10) Patent No.: US 7,670,051 B2
(45) Date of Patent: Mar. 2, 2010

(54) LEAK PROOF RE-CLOSABLE FLEXIBLE POUCH

(76) Inventor: Ashok Chaturvedi, 110, First Floor, Bhanot Corner, Pamposh Enclave, Greater Kailash-1, New Delhi (IN) 110 043

( * ) Notice: Subject to any disclaimer, the term of this patent is extended or adjusted under 35 U.S.C. 154(b) by 901 days.

(21) Appl. No.: 10/554,892

(22) PCT Filed: Oct. 15, 2004

(86) PCT No.: PCT/IN2004/000323

§ 371 (c)(1),
(2), (4) Date: Oct. 28, 2005

(87) PCT Pub. No.: WO2006/040777

PCT Pub. Date: Apr. 20, 2006

(65) Prior Publication Data

US 2006/0269170 A1 Nov. 30, 2006

(30) Foreign Application Priority Data

Oct. 11, 2004 (IN) ..... 1974/DEL/2004

(51) Int. Cl.
*B65D 33/16* (2006.01)
*A44B 19/16* (2006.01)
*A44B 19/00* (2006.01)

(52) U.S. Cl. ..... 383/64; 24/399; 24/585.12

(58) Field of Classification Search ..... 383/64, 383/61.3, 63, 48, 53, 54, 59, 44, 61.1; 24/399, 24/400, 585.12, 415, 427, 30.5 R, 576, 587, 24/585.1
See application file for complete search history.

(56) References Cited

U.S. PATENT DOCUMENTS 5,836,056 A * 11/1998 Porchia et al. ..... 24/400

(Continued)

FOREIGN PATENT DOCUMENTS

WO WO 00/76352 12/2000

OTHER PUBLICATIONS

International Search Report dated Apr. 11, 2007 in PCT/IN2004/000323.

*Primary Examiner*—Jes F Pascua

(57) ABSTRACT

The invention provides for a slider for a leak proof slider-zipper assembly having a leading edge and a trailing edge comprising a pair of protrusions at the bottom of the leading edge, a pair of protrusions at the bottom of the trailing edge, and an opening plow protruding from the top surface of the slider, between the leading edge and trailing edge, and having height not more than the height of the slider. The opening plow has a sloping surface from the leading edge towards the trailing edge such that the height of the opening plow at the leading edge is less than the height of the opening plow at the trailing edge.

11 Claims, 16 Drawing Sheets

U.S. PATENT DOCUMENTS 5,950,285 A * 9/1999 Porchia et al. ..... 24/400
5,956,815 A * 9/1999 O'Connor et al. ..... 24/30.5 R
6,088,887 A * 7/2000 Bois ..... 24/399
6,220,754 B1 * 4/2001 Stiglic et al. ..... 383/64
6,431,754 B1 * 8/2002 Savicki, Sr. ..... 383/64
6,450,686 B1 * 9/2002 May ..... 383/64
6,575,628 B1 * 6/2003 Borchardt et al. ..... 383/64
6,612,002 B1 * 9/2003 Savicki ..... 24/585.1
6,883,210 B1 * 4/2005 Savicki ..... 24/30.5 R
6,895,641 B1 * 5/2005 Savicki ..... 24/30.5 R
6,981,299 B2 * 1/2006 Savicki, Sr. ..... 24/399
6,983,573 B2 * 1/2006 Buchman ..... 53/412
7,134,192 B1 * 11/2006 Savicki et al. ..... 29/766
7,165,292 B2 * 1/2007 Kasai ..... 24/30.5 R
7,213,303 B1 * 5/2007 Savicki ..... 383/64
2001/0039698 A1 * 11/2001 Siegel ..... 24/415
2006/0210201 A1 * 9/2006 Ackerman et al. ..... 383/61.2

* cited by examiner

LEAK PROOF RE-CLOSABLE FLEXIBLE POUCH

The invention relates to a leak proof re-closable bag. More particularly the invention relates to a leak proof flexible pouch with a slider zipper.

BACKGROUND OF THE INVENTION

The use of re-closable flexible pouches has seen dramatic increase in the last few years. Heretofore the primary market for bags with slider zippers has been consumers who purchase empty slider bags and then fill the slider bags with products at home. However, with the increasing popularity of slider bags most manufacturers now tend to package their food and non-food products in slider bags for sale to consumers. The slider bags are a great convenience to the consumer who purchases these product filled bags especially for products of the type where only a portion of the product is used at any given time. The product applications for which slider bags may be used are virtually unlimited.

Plastic bags having zipper closures typically consist of two substantially similar sized sheets of plastic film (usually supplied from a pair of continuous web spools or rolls) which are then sealed together at a lower end of the sheets to form a front layer and a rear layer, with the seal forming a bottom edge of the bag. Alternatively, the plastic bag may be formed by a length of bag film folded upon itself to form a front layer and a rear layer connected by an integral bottom edge defined by the fold. Side edges of the plastic bag are typically sealed using a sealing head.

The typical slider bags that are being manufactured are airtight as far as solids and powders are concerned. However, the bags are neither leak proof nor drip free where liquids are concerned. The problem of leakage is two fold in that leakage occurs due to the improper sealing of the side edges and also due to improper design of the slider and zipper.

The zipper closure itself is airtight along its length due to the releasable and reusable seal formed by the inter-locked profile. A long standing problem in the art of zipper sealed plastic bags however has been the presence of escape gaps which are created during heat sealing at the outermost edges (such as at the bags two side seal locations) of the zipper closure. A drawback of such a method of sealing is the escape gaps that are formed at the intersection of the zipper closure, the bag film, and the side edges of the plastic bag. These escape gaps are frequently formed as a result of applying continuous pressure and heat to seal the side edges of the bag, without making accommodations for the underlying zipper closure that is typically already sealed along the top edge of the bag film. Such escape gaps facilitate leakage of air and/or liquid directly into or out of the contents of the plastic bag, which can cause undesired spillage, contamination and spoilage of such contents.

U.S. Pat. No. 3,986,914 and U.S. Pat. No. 6,033,113, incorporated here in totality by reference, address this problem and have provided methods of overcoming this drawback. U.S. Pat. No. 3,986,914 provides for a plastic bead seal at the junction of the interlocking fastener and the side edges of the container. The plastic bead seal formed by a pressure bar, acts as a barrier to the passage of fluids or contaminating bacteria through the fastener at this junction. One drawback of the method of providing bead seals is that the bead seals are formed as a separate step in the manufacturing process. Also, the pressure bar with the specially configured channel is not found on conventional bag making machinery.

U.S. Pat. No. 6,033,113 provides for a zipper closure that is provided with fillets along the uppermost and lowermost interlocking fingers of the zipper to prevent escape gaps from forming between the two sides, especially at the bags side seal locations. Conventional heat dies are used in combination with excess quantities of plastic material to form the fillets. The method of fillets involves the use of extra plastic materials for the fillets.

To overcome this problem of escape gaps in particular at the side edges, the invention provides for the use of a sealing head with grooves made on their inner surfaces such that excess material may flow into the grooves of the sealing head and not result in escape gaps being created during the cooling stage. This may be better understood with reference to FIG. 16, wherein the grooved edges are shown (35).

The slider device typically includes a separator or plow-type structure in the middle, or at one end, that opens a zipper closure mechanism having male and female interlocking profiled elements or closure profiles when the slider device travels in a first direction along the zipper closure. The sidewalls of the slider device are inwardly tapered from one end to the opposite end so that the sidewalls engage the closure profiles and progressively move them into engagement to close the re-closable package when the slider device is moved along the zipper closure in a direction opposite to the first direction.

Re-closable packages that include a slider device to more easily open and close the profiles typically face problems in providing a liquid tight seal across the entire length of the zipper closure due to the fact that the slider includes a plow device used to separate the closure profiles as the slider is moved along the length of the zipper closure. Thus a portion of the zipper closure beneath the plow remains open at all times. One way of solving this problem is to include a notch formed in the mating profiles above the inter-locking elements to define a home position for the slider when the package is in the completely closed position. The notch formed in the profile typically receives the plow formed on the slider such that the profile can be closed on each side of the plow to create a continuous seal across the entire package. Typically, the plow of the slider device does not extend past the interlocking elements such that the notch does not create an opening between the inter-locking elements formed on the closure profiles.

Although the notch formed in the mating profile on the closed end of the re-sealable package is known, problems can occur in utilizing such a notch with a full-length plow. For example, during the formation of the notch portions of the re-sealable package near the location of the notch can be damaged which affects the performance of the package.

U.S. Pat. No. 4,890,935 describes a slider wherein a foam plastic gasket material is positioned between the inter-locking profile elements of the zipper at the closing end of the pouch and sealed thereof. The opposite end of the gasket material is free and extends into the space between the profiles at the closing end of the bag. When the leading edge of the slider is brought into engagement with the gasket material a seal is formed thereby eliminating the gap which otherwise would form in the area occupied by the free end of the gasket. A slider tab is also provided on the slider to engage a hook at the end of the zipper closure to hold the slider in position and maintain the seal. This method though effective is not practical as the addition of the gasket material and hook not only increases costs but also involves an extra step in manufacturing. Furthermore closing of the pouch involves an extra step of hooking the slider tab to maintain the seal. These factors make this method unviable.

U.S. patent application 2004/0086206 provides for a seal region between the flaps of the male and female closures, such that the seal extends towards the center of the package from the edge and is of a pre-defined length. This pre-defined length of the seal is greater than the length of the slider. The seal region therefore provides a fluid tight seal between the two sealed flaps and below the slider when the slider is in the home position. Theoretically the method of preventing leakage at the ends of the zipper as described by U.S. 2004/0086206 appears to meet its objective. However, experimentation has found that liquid tends to seep into the gap between the seal and the zipper and leak out through the gap in the zipper profile at the end edge due to the plow. Further, the method also involves the use of extra sealing material as well as an extra manufacturing step that adversely affects costs.

OBJECTS AND SUMMARY OF THE INVENTION

It is therefore an object of the invention to provide a re-closable flexible bag that is leak proof and drip proof.

It is an object of the invention to provide a slider for the zipper of a re-closable bag that makes the bag leak proof.

It is an object of the invention to provide a leak proof re-closable bag without increasing the cost of the bag.

It is an object of the invention to provide a leak proof re-closable bag that can hold solids, liquids and gases.

To meet the aforementioned and other objectives the invention provides for a slider for a leak proof slider-zipper assembly having a leading edge and a trailing edge comprising:

- a pair of protrusions at the bottom of the leading edge,
- a pair of protrusions at the bottom of the trailing edge, and
- an opening plow protruding from the top surface of the slider, between the leading edge and trailing edge, and having height not more than the height of the slider.

The invention also provides for a re-closable flexible package comprising:

- a pair of side panels joined along a first side edge and a second side edge, the panels defining a mouth providing access to a package interior,
- a zipper closure positioned along the mouth of the package for selectively opening and closing the package mouth, the zipper including a first pair of inter-locking members and a second pair of inter-locking members below it,
- a slider for opening and closing the zipper closure having a leading edge and a trailing edge, the slider having a pair of protrusions at the bottom of the leading edge, a pair of protrusions at the bottom of the trailing edge, and an opening plow protruding from the top surface of the slider, between the leading edge and trailing edge, wherein the height of the opening plow is such that it penetrates only the first pair of inter-locking members of the zipper closure.

BRIEF DESCRIPTION OF ACCOMPANYING DRAWINGS

The accompanying drawings illustrate the preferred embodiments of the invention and together with the following detailed description serve to explain the principles of the invention.

DETAILED DESCRIPTION OF THE INVENTION

It will be understood by those skilled in the art that the foregoing general description and the following detailed description are exemplary and explanatory of the invention and are not intended to be restrictive thereof.

At the outset it would be appropriate to mention that leading edge refers to the edge of the slider that leads when the slider is moved to close the zipper. Similarly, trailing edge refers to the edge that leads when the slider is moved to open the zipper.

Through out the patent specification, a convention employed is that in the appended drawings, like numerals denote like components.

To overcome the aforementioned drawbacks of the prior art the invention provides for a slider that has a plow (alternatively plough) that extends only up to the first interlocking members of a zipper profile. The slider also has closing profiles at both leading and trailing edges at the lower end, such that the bottom inter-locking members of the zipper are sealed irrespective of the direction of movement of the slider. This ensures that the bottom inter-locking members are sealed by the slider profile and not opened by the plow, at the edges of the zipper profile thereby providing for a leak proof re-closable bag. The invention will now be explained with reference to the following embodiment.

Figure 1:
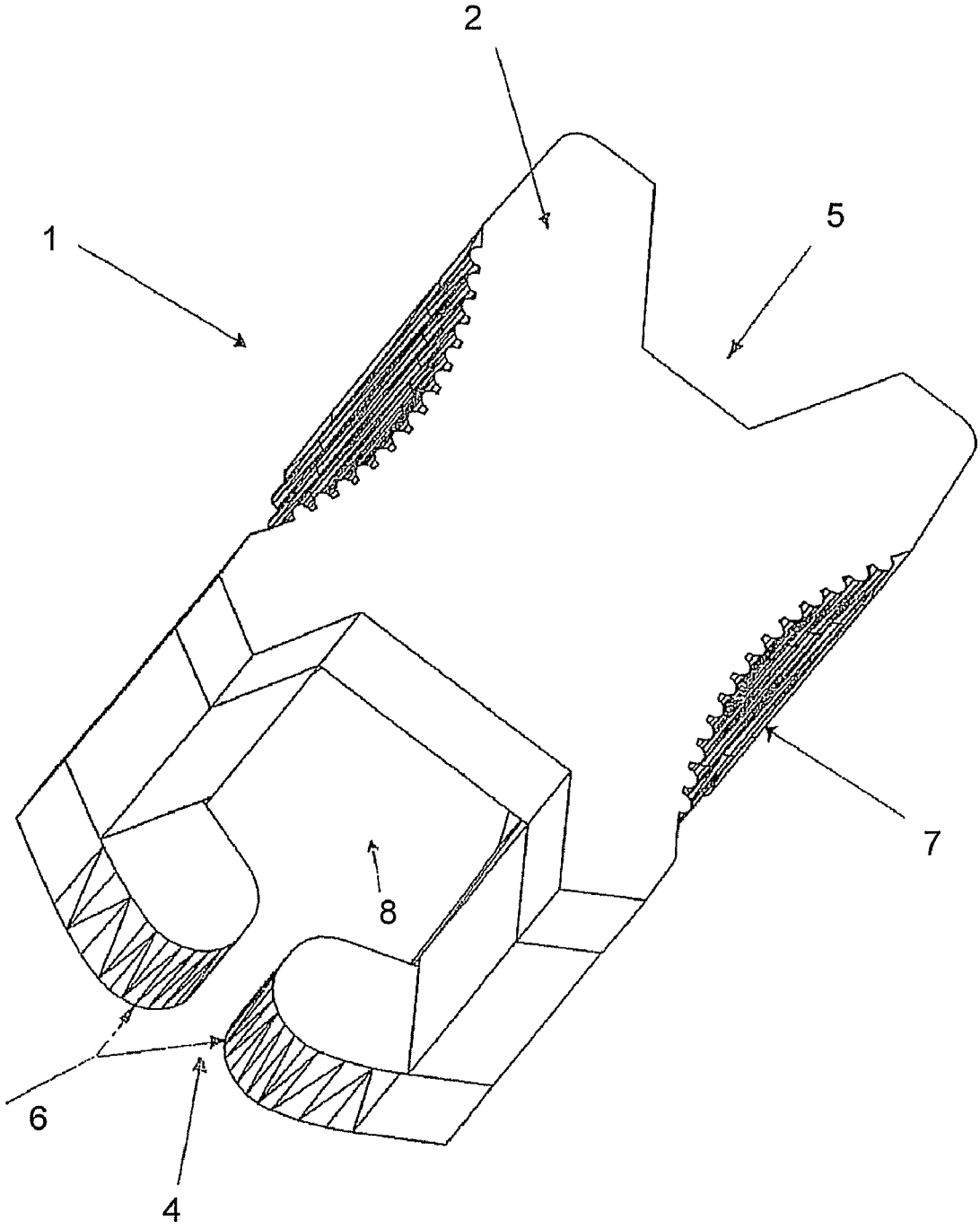
FIG. 1 illustrates a front-top perspective view of the slider in accordance with the invention.

FIG. 1 illustrates a front-top perspective view of the slider (1) having a top surface (2) in accordance with the invention. The slider has a leading edge (4) and a trailing edge (5). The leading edge (4) has a pair of protrusions (6) at the bottom surface (3) of the slider. An open area (8) is formed between the bottom protrusions (6) and the top surface (2). The two sides of the zipper last pass through these protrusions and the open area (8) when the slider is moved along the zipper in the opening direction. The slider is also provided with a grooved outer surface (7) for better gripping. The grip enables firm holding of the slider even with wet hands.

Figure 2:
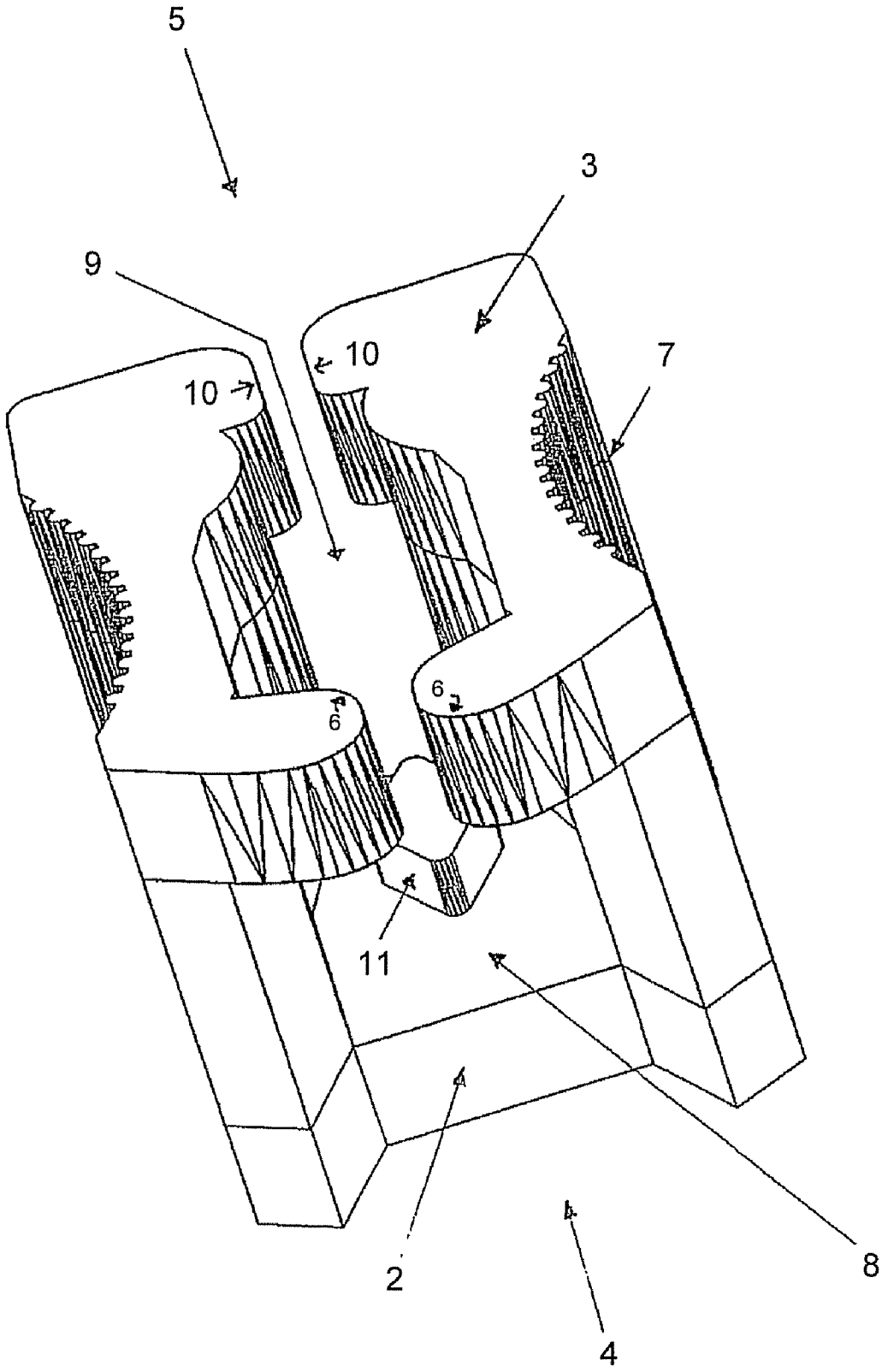
FIG. 2 illustrates a front-bottom perspective view of the slider in accordance with the invention.
Figure 5:
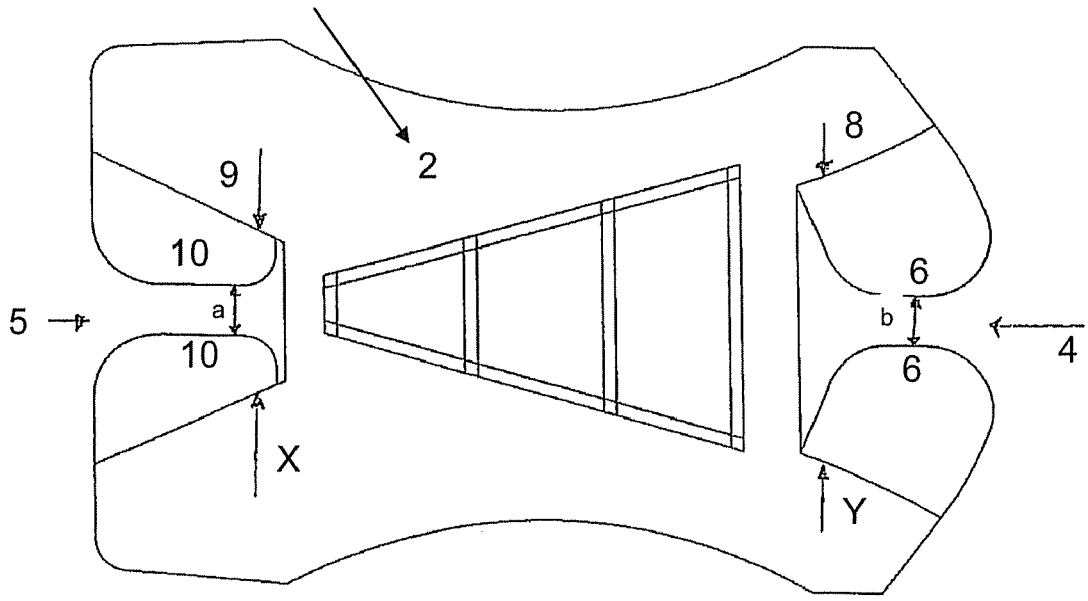
FIG. 5 illustrates a top view the slider in accordance with the invention.

Referring now to FIG. 2 a front-bottom perspective view is shown. As shown the trailing edge (5) also has a pair of protrusions (10) at the bottom surface (3). An open area (9) is formed between the protrusions (10) and the top surface (2) of the slider. The two sides of the zipper last pass through these protrusions and the open area (9) when the slider is moved along the zipper in the closing direction. As may be observed, open area (9) at the trailing edge is smaller than the open area (8) at the leading edge. This may be visualized better in FIG. 5 that depicts the top of the slider, wherein the opening at (9) measured as (X) is smaller than the opening at (8) measured as (Y). As can also be seen at the bottom surface (3) the gap between the protrusions at the leading edge and the trailing edge (a, b) is substantially the same.

Figure 3:
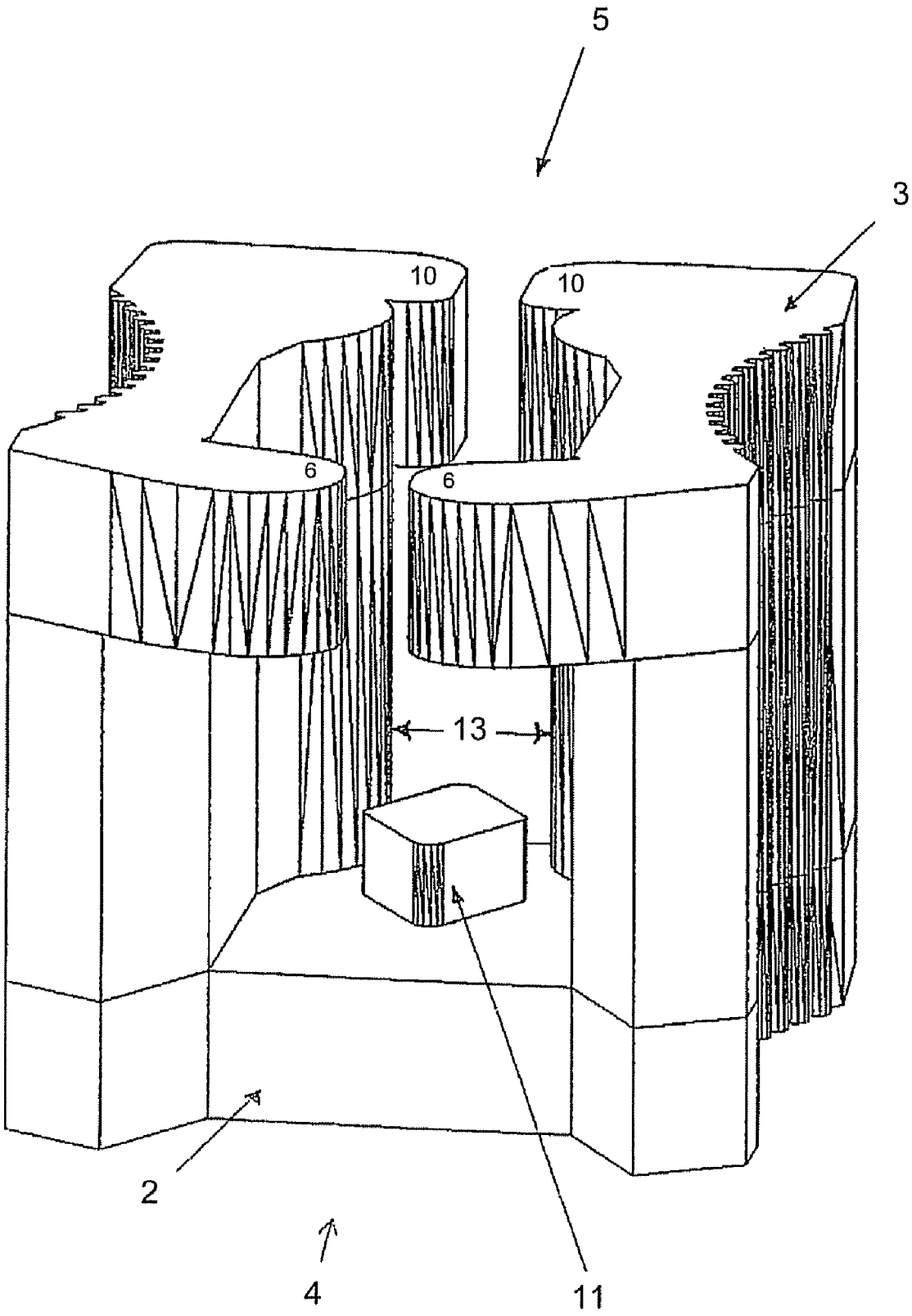
FIG. 3 illustrates a front view of the slider in accordance with the invention.

FIG. 3 shows a central notch or plow (11) hanging down from the top surface (2) of the slider (1). As shown, the plow (11) does not extend along the full height of the slider. The plow height is such that it penetrates only the first pair of interlocking members of the zipper, as explained in detail below. The plow is positioned approximately at the center of the slider. It should be noted that the shape and position of the plow may be varied as per requirement, and the figure serves only to describe an embodiment of the invention.

Figure 4:
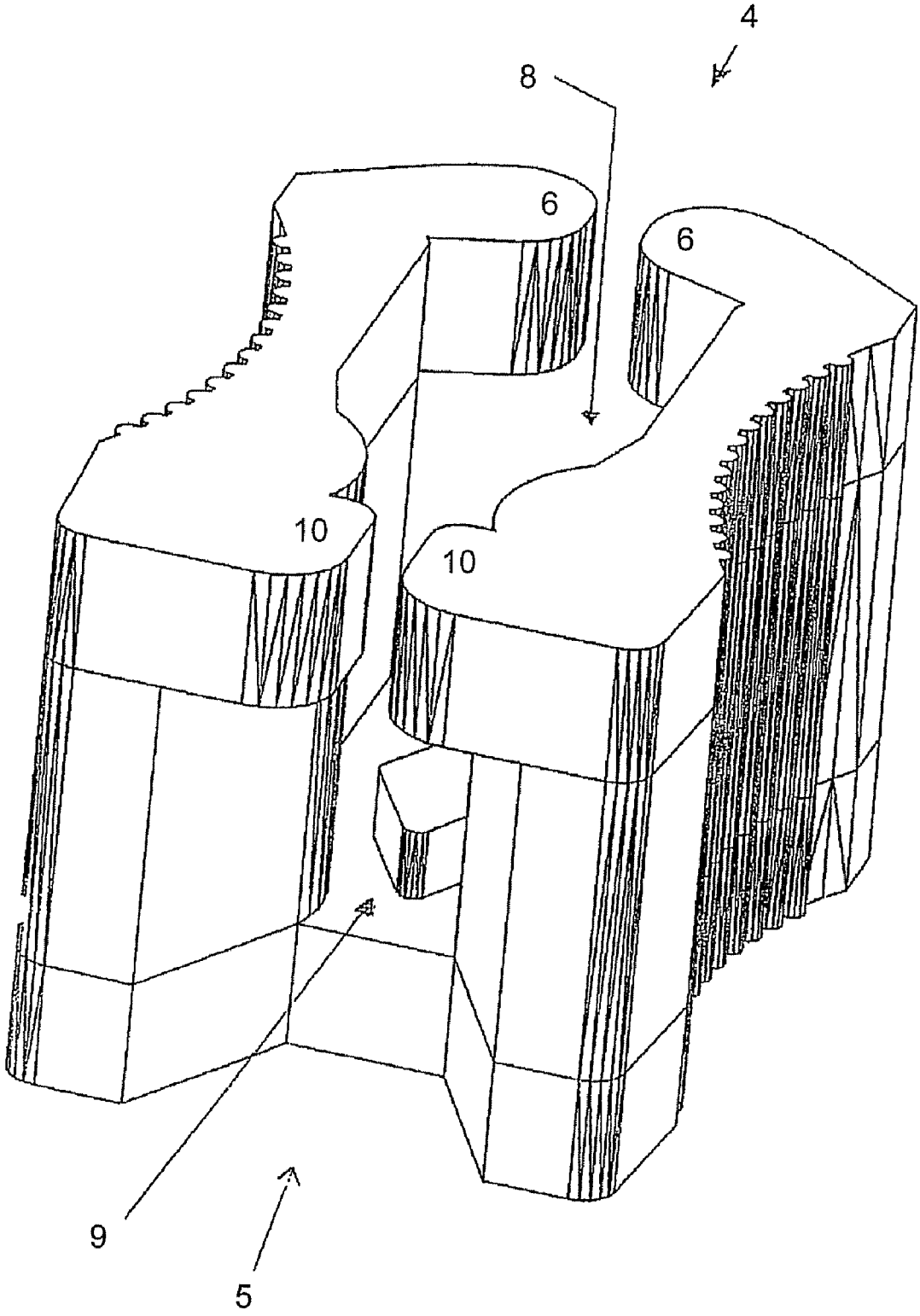
FIG. 4 illustrates a back-bottom perspective view of the slider in accordance with the invention.

FIG. 4 illustrates a back bottom perspective view of the slider. As can be seen, the trailing edge (5) has a pair of protrusions (10), distance between the protrusions being such that the two sides of the zipper when made to pass through these protrusions will be pressed against each other and consequently sealed together. The trailing edge also has an open area (9), width of the open area (9) being such that the two sides of the zipper are not allowed to separate and the seal is maintained.

Figure 6:
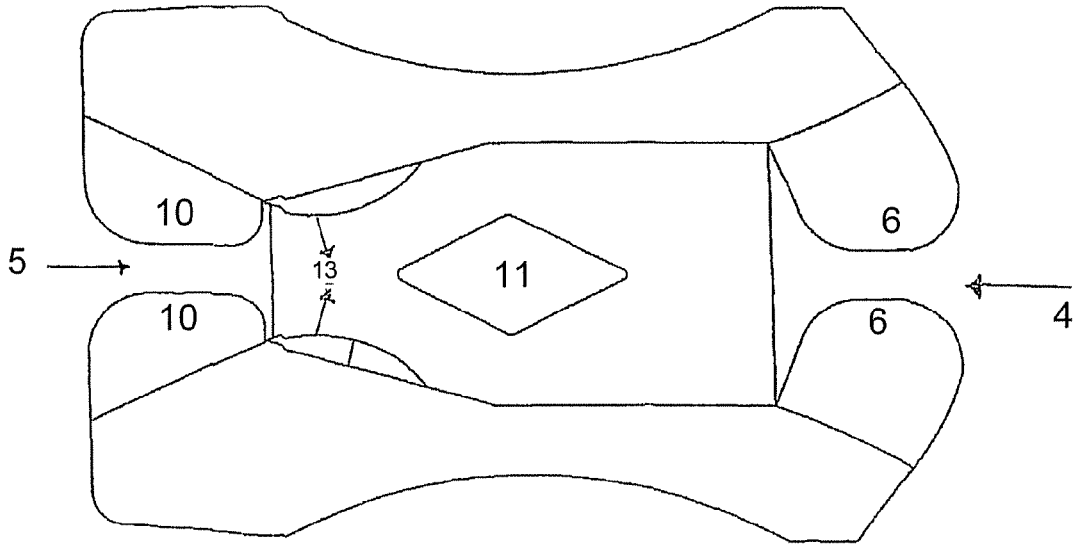
FIG. 6 illustrates a bottom view of the slider in accordance with the invention.

FIG. 6 illustrates a schematic bottom view of the slider in accordance with the invention. As can be seen, the trailing edge (5) in addition to the protrusions (10) at the bottom surface (3) also has protrusions (13) that extend substantially between the top and bottom surfaces. These protrusions (13) may be better visualized in FIG. 3. The protrusions (13) serve to reduce the open area (9) at the trailing edge such that the two sides of the zipper are pressed against each other.

Figure 7:
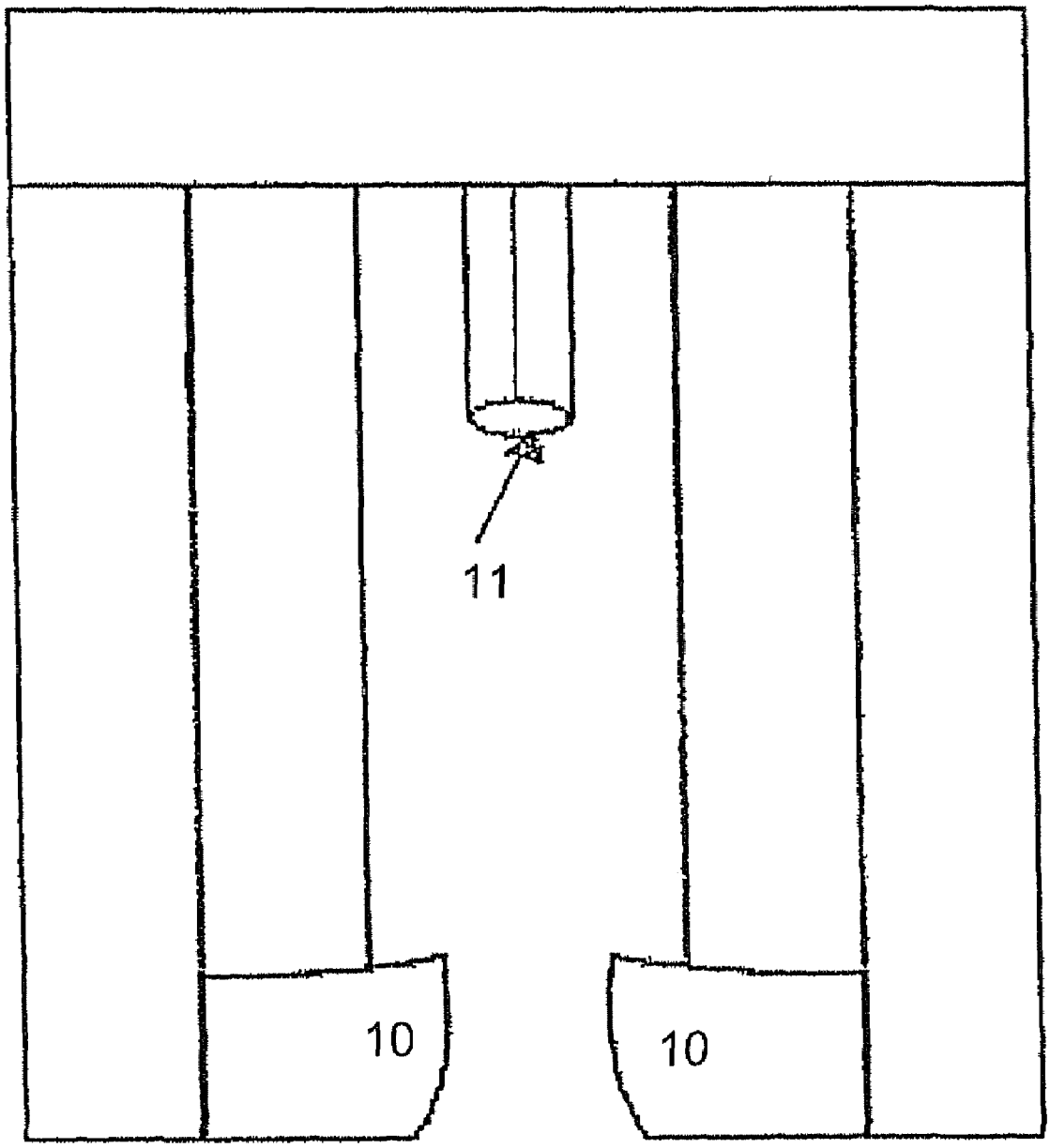
FIG. 7 illustrates schematic back view of the slider in accordance with the invention.

FIG. 7 illustrates a schematic back view of the slider showing the bottom protrusions (10) and the plow (11).

Figure 8:
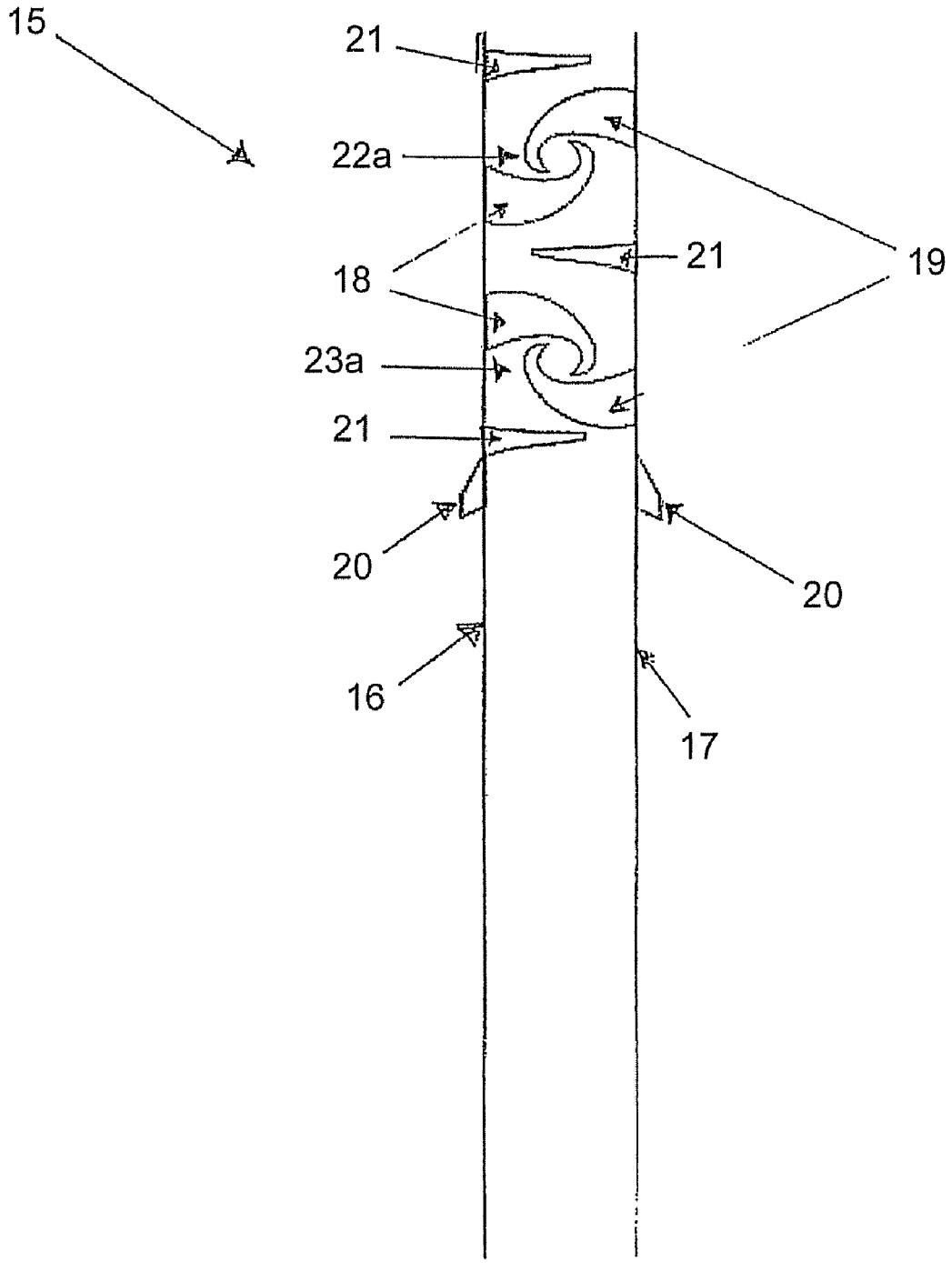
FIG. 8 illustrates a zipper for a re-closable bag in accordance with the invention.

Referring now to FIG. 8 a zipper (15) in accordance with the invention is shown. The zipper has two sides (16,17) having corresponding inter-locking profile elements (18,19). The zipper (15) is also provided with intermediate profile elements (21) that serve to align the two sides (16,17) of the zipper. As can be seen the upper members of inter-locking profile members (18,19) form a first or upper seal (22*a*). Similarly, the bottom members of the interlocking profile members (18,19) form the second or lower seal (23*a*). The zipper is also provided with external projections (20) on both sides (16,17) of the zipper. These projections (20) serve to lock the slider onto the zipper and to prevent the slider from detaching from the zipper.

Figure 9:
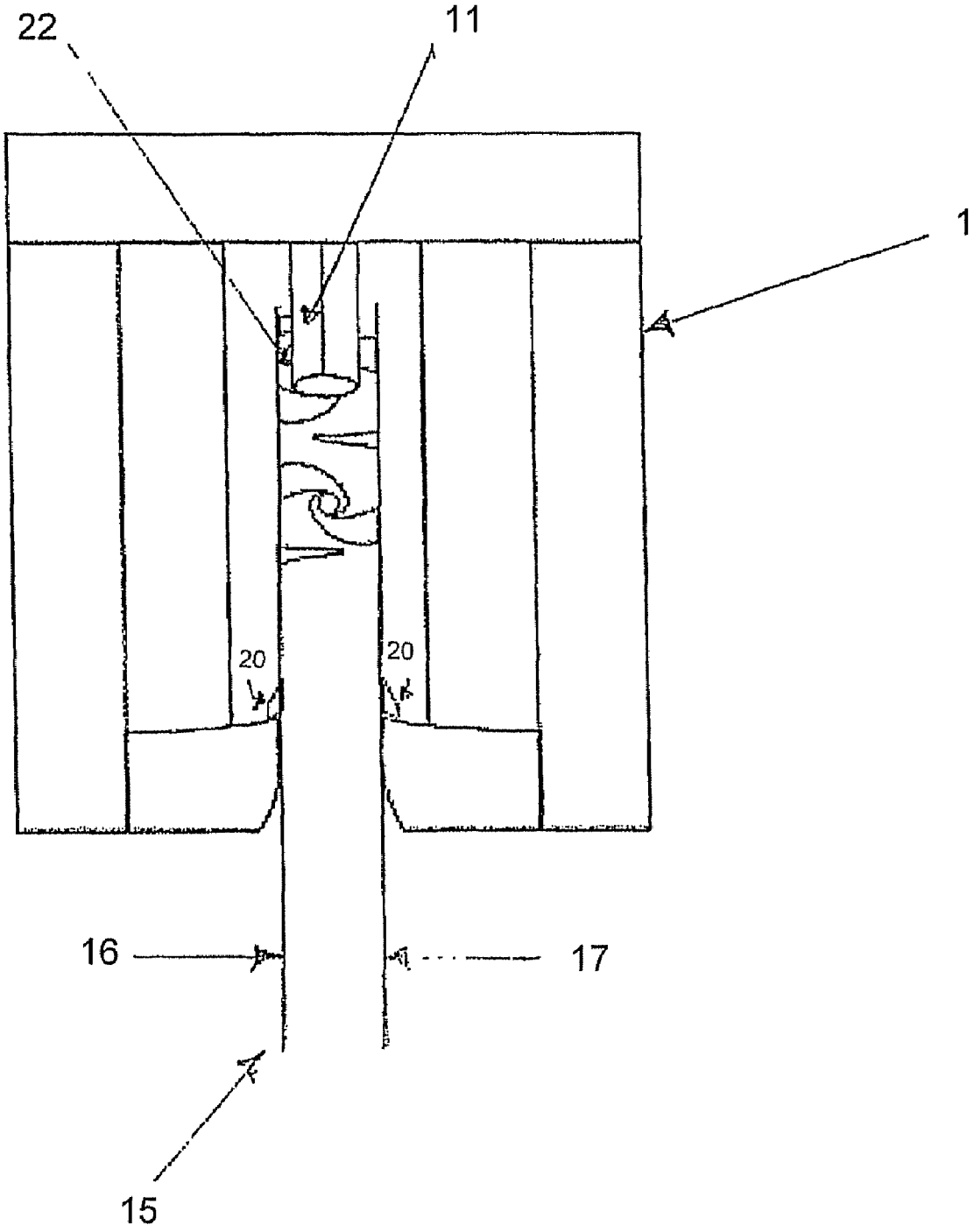
FIG. 9 illustrates the slider mounted on a zipper in accordance with the invention.

FIG. 9 illustrates a schematic of the slider (1) fitted on to zipper (15) in accordance with the invention. As can be seen projections (20) help retain the slider onto the zipper by providing a positive lock. The opening plow (11) also extends only up to the first pair of inter-locking members (22). Thus when the slider is made to move over the zipper, the plow opens only the first seal (22*a*) of the inter-locking members. The bottom seal (23*a*) of the inter-locking members is opened by virtue of the design, in that, once the upper pair of inter-locking members (22) is opened the lower pair tends to separate also.

Figure 10:
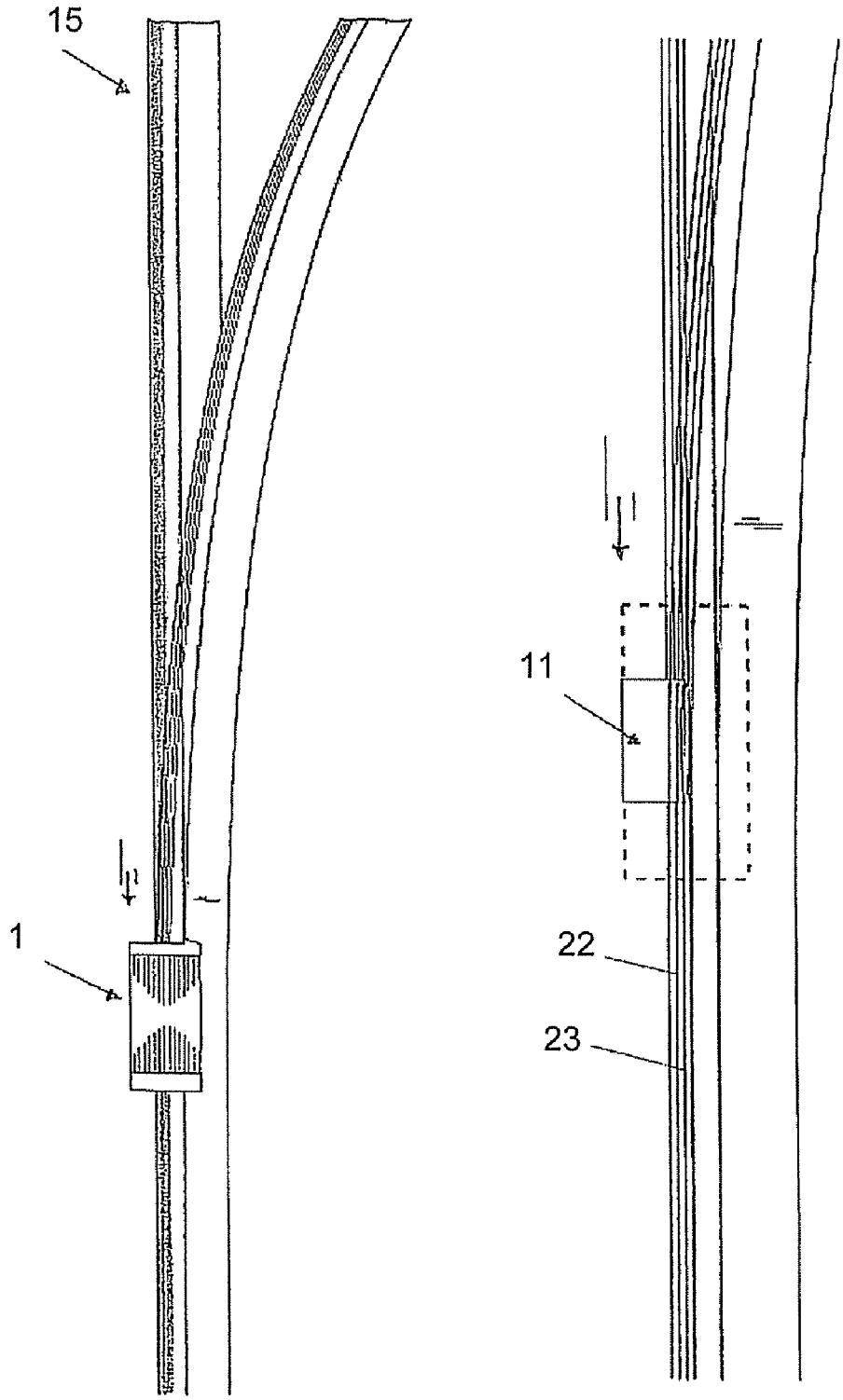
FIGURE 10 PRIOR ART
FIG. 10 illustrates the opening action performed by a conventional slider zipper.
Figure 11:
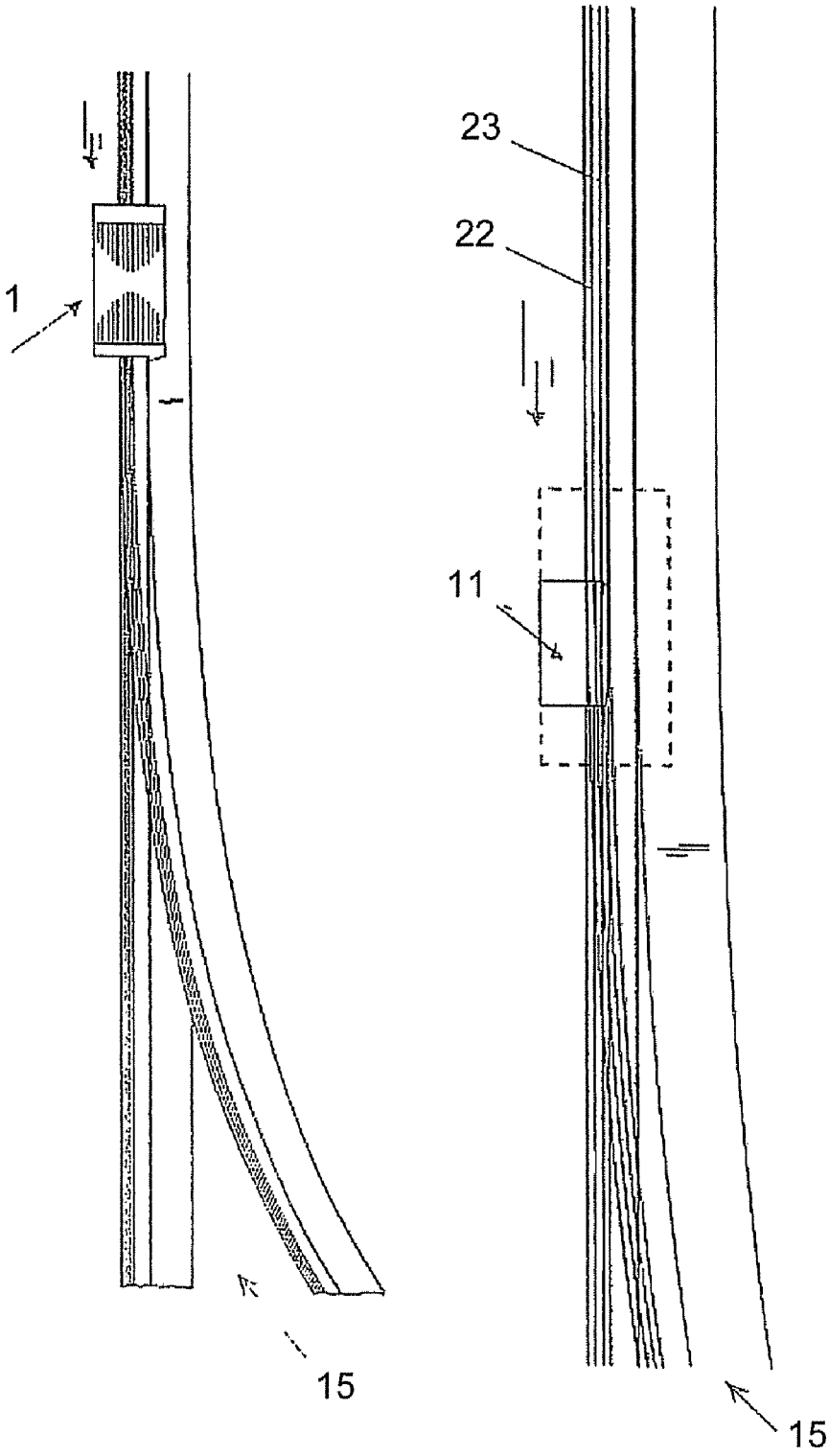
FIGURE 11 PRIOR ART
FIG. 11 illustrates the closing action performed by a conventional slider zipper.
Figure 14:
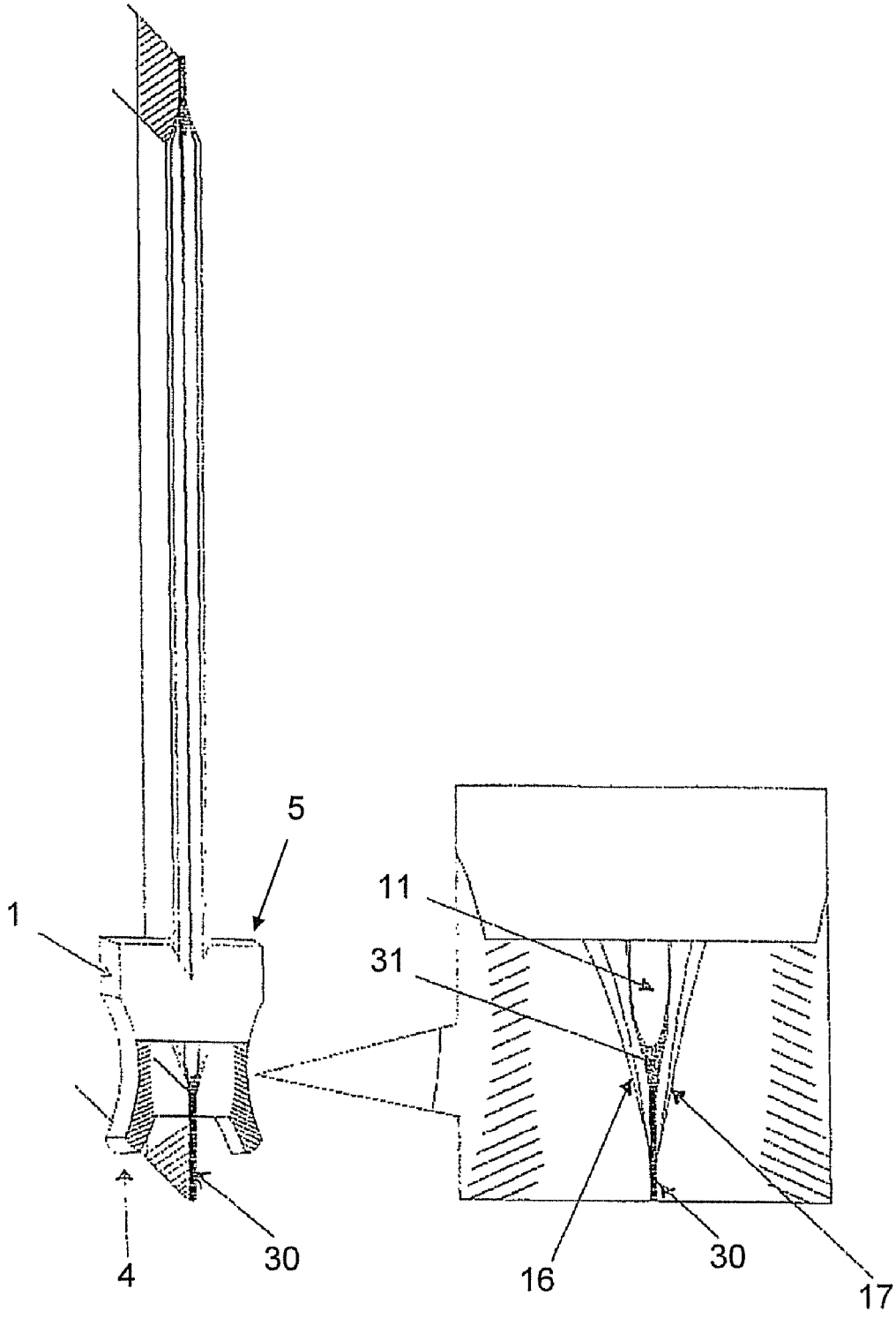
FIGURE 14 PRIOR ART
FIG. 14 illustrates the drawback of conventional slider zippers at the closing home position of the slider.

FIGS. 10 and 11 illustrate the conventional slider opening and closing a zipper respectively. As can be seen from the figures the opening plow extends up to both the pairs of inter-locking members (22,23). Also the plow (11) has the same height throughout. The problem with this conventional slider and plow is that at the closing edge the central plow separates the two sides (16,17) of the zipper completely. This leads to small escape gaps between the zipper edge and the leading edge of the opening plow through which leakage may occur. This may be better understood by FIG. 14. As shown, the slider (1) is at its closing home position with the leading edge in touch with the sealed edge of the bag. The edges of the bag are sealed (30) along with the two sides (16,17) of the zipper. In the expanded view box, as shown, the two sides of the zipper (16,17) are separated by the opening plow (11). This results in the formation of minute gaps (31) between the tip of the opening plow (11) and the edge of the seal (30).

Figure 12:
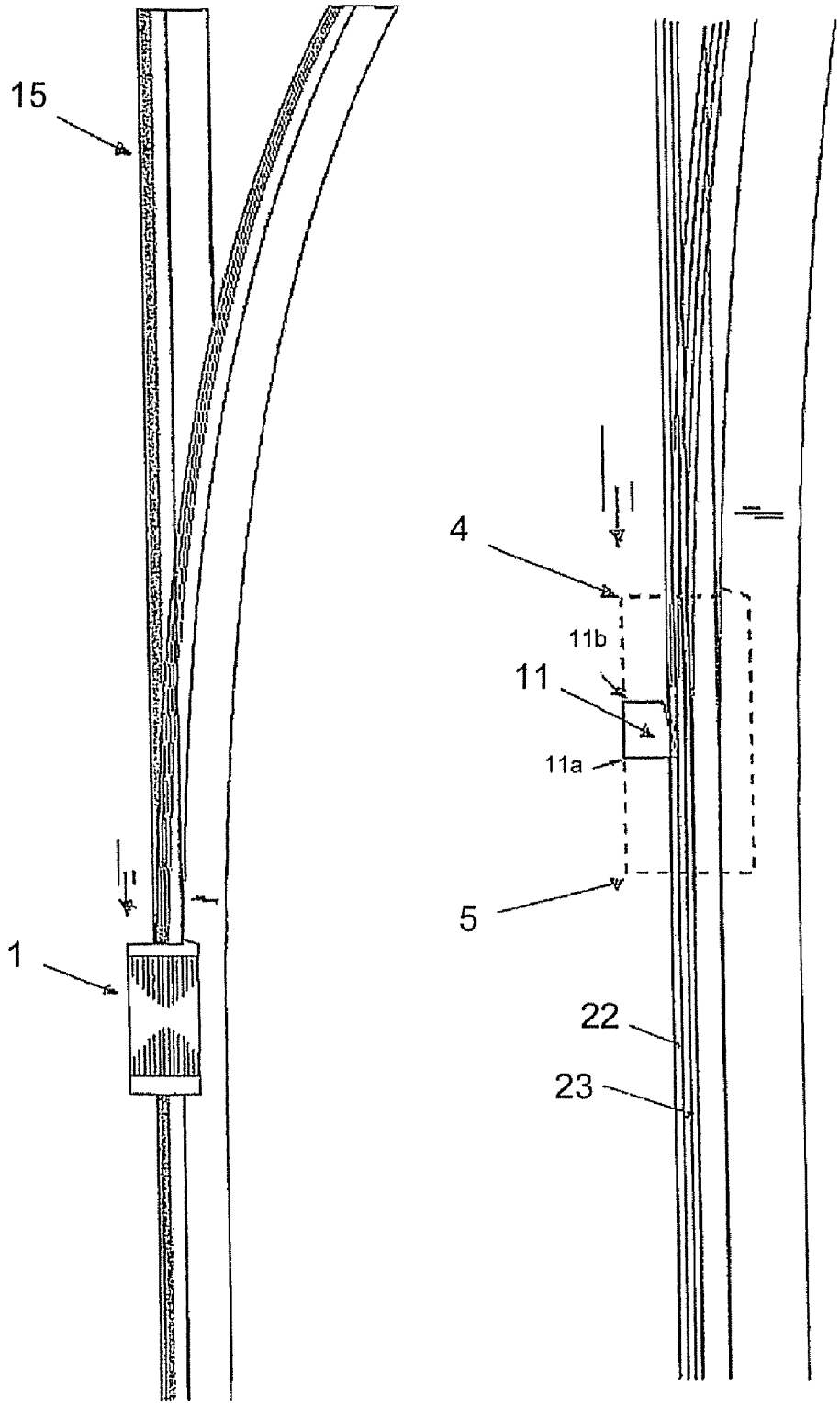
FIG. 12 illustrates the opening action performed by the slider zipper in accordance with this invention.

FIG. 12 illustrates the opening action performed by the slider zipper in accordance with this invention. As can be seen from the figure, slider (1) is moving towards the left to open the zipper (15). The opening plow (11) in accordance with the invention has a longer edge (11*a*) and a shorter edge (11*b*). The opening plow (11) has a height such that it only penetrates the first or upper pair of inter-locking members (22). Accordingly, the longer edge first passes through first pair of interlocking members (22) and opens the seal.

The opening mechanism may be explained as follows:—

During the opening action, the leading edge (4) of the slider follows the trailing edge (5). The trailing edge has bottom protrusions (10) and open area (9), both which ensure that the two sides of the zipper (16,17) remain pressed against each other. Thus when the slider is moved over the zipper in the opening direction, the two sides (16, 17) of the zipper that first pass through the trailing edge are sealed and both the pairs of inter-locking members (22,23) are locked. The two sides (16,17) then encounter the opening plow (11), wherein the first pair of inter-locking members (22) are opened by the longer edge (11*a*) of the plow (11). The opening plow (11) however does not open the bottom pair of inter-locking members (23). When the slider is moved further ahead, the two sides of the zipper are made to pass through the leading edge (4) of the slider. The leading edge (4) has protrusions (6) at the bottom and an open area (8). On passing through the leading edge, the open area (8) of the slider is such that the opened first pair of inter-locking members (22) are kept open. The protrusions (6) of the leading edge keep the bottom or lower pair of inter-locking members (23) locked. Thus on leaving the leading edge (4) the upper pair (22) is open whereas the bottom pair (23) is locked. However, by virtue of the design and flexibility of the material used for the zipper, the open upper pair (22) causes the lower pair (23) also to open thereby opening the zipper.

Figure 13:
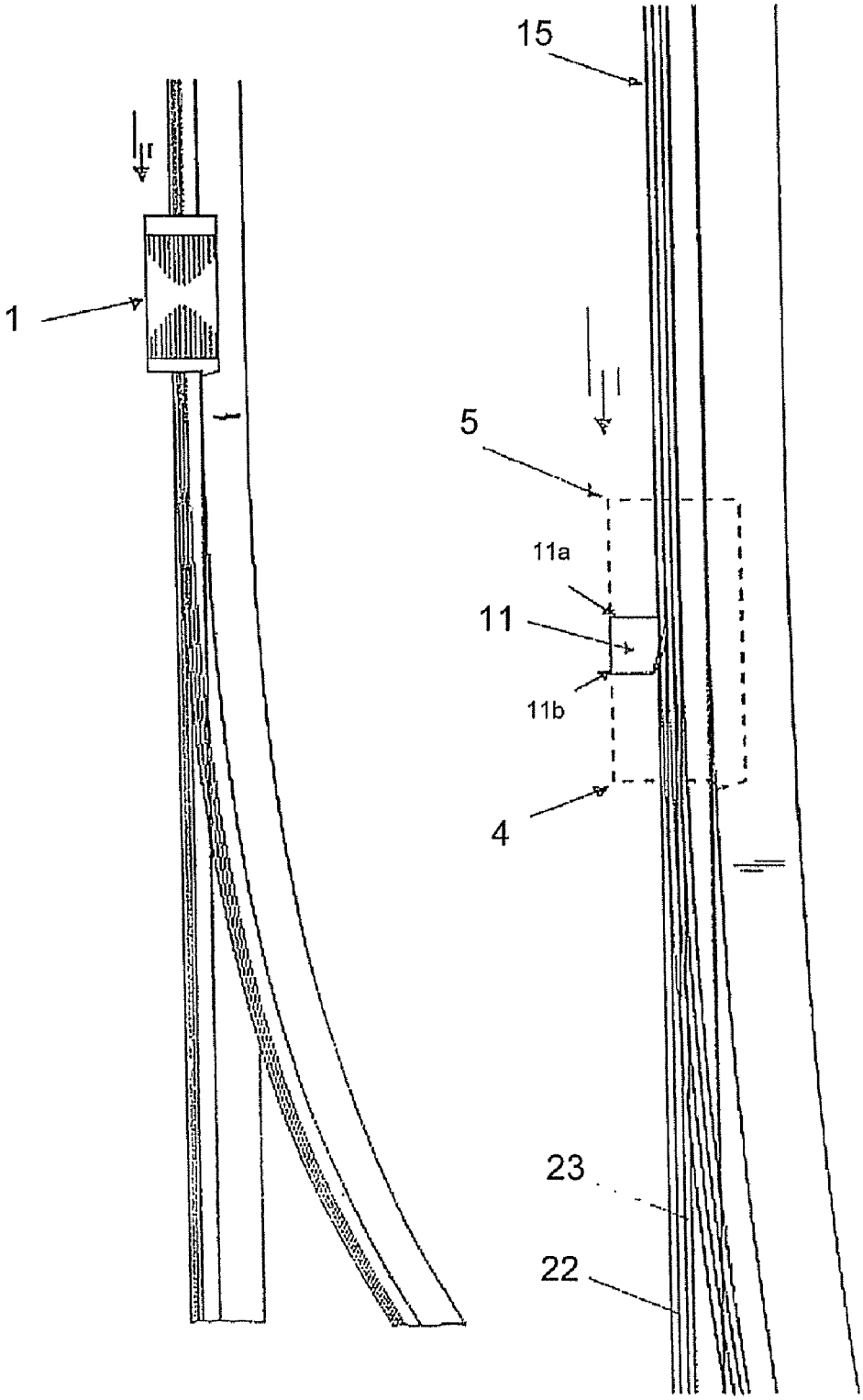
FIG. 13 illustrates the closing action performed by the slider zipper in accordance with this invention.

FIG. 13 illustrates the closing action performed by the slider zipper in accordance with this invention. As can be seen from the figure, slider (1) is moving towards the left to close the zipper (15). The opening plow (11) has a height such that it only penetrates the first or upper pair of inter-locking members (22), and has a longer edge (11*a*) and a shorter edge (11*b*). In accordance with the invention the shorter edge (11*b*) first passes through first pair of interlocking members (22).

The closing mechanism may be described as follows:

During the closing action, the trailing edge (5) of the slider follows the leading edge (4). The leading edge has bottom protrusions (6) and open area (8). The protrusions (6) ensure that the two sides of the zipper (16,17) remain pressed against each other at the lower pair of inter-locking members (23). Thus when the slider is moved over the zipper in the closing direction, the two sides (16, 17) of the zipper first pass through the leading edge, the lower or bottom pair of inter-locking member (23) is locked, while due to the substantially larger open area (8) the upper pair of inter-locking members (22) remain open. The two sides (16,17) then encounter the opening plow (11), wherein the first pair of inter-locking members (22) is kept open by the longer edge (11*a*) of the plow (11). The opening plow (11) however does not open the bottom pair of inter-locking members (23). When the slider is moved further ahead, the two sides of the zipper are made to pass through the trailing edge (5) of the slider. The trailing edge (5) has protrusions (10) at the bottom and an open area (9). On passing through the trailing edge, the open area (9) of the slider is such that the opened first pair of inter-locking members (22) is now locked and the sealing is complete. The protrusions (10) of the trailing edge keep the bottom or lower pair of inter-locking members (23) locked. Thus on leaving the trailing edge (5) both the pairs of inter-locking members (22, 23) are locked giving a complete seal.

Figure 15:
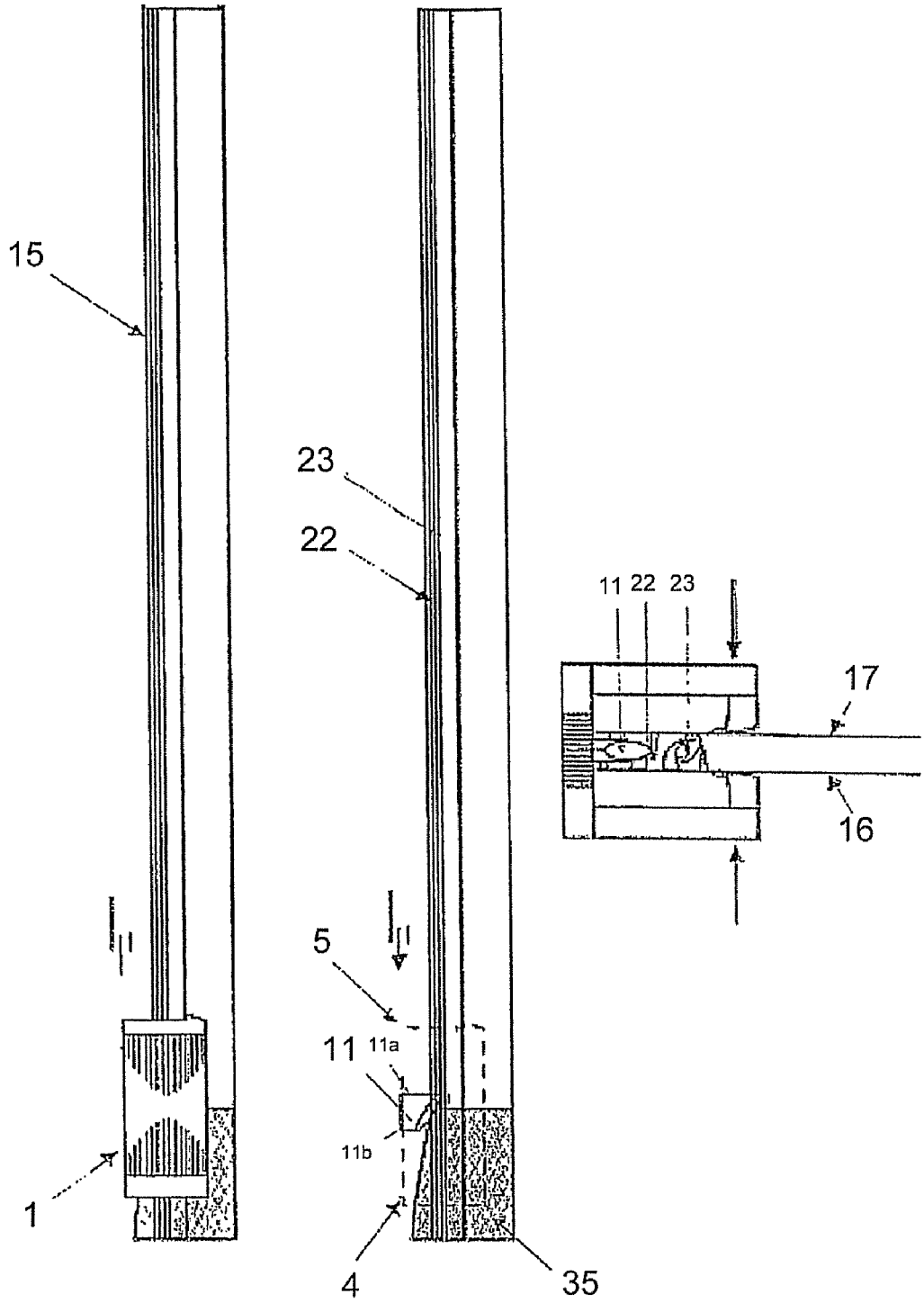
FIG. 15 illustrates the slider in accordance with this invention at its closing home position.
Figure 16:
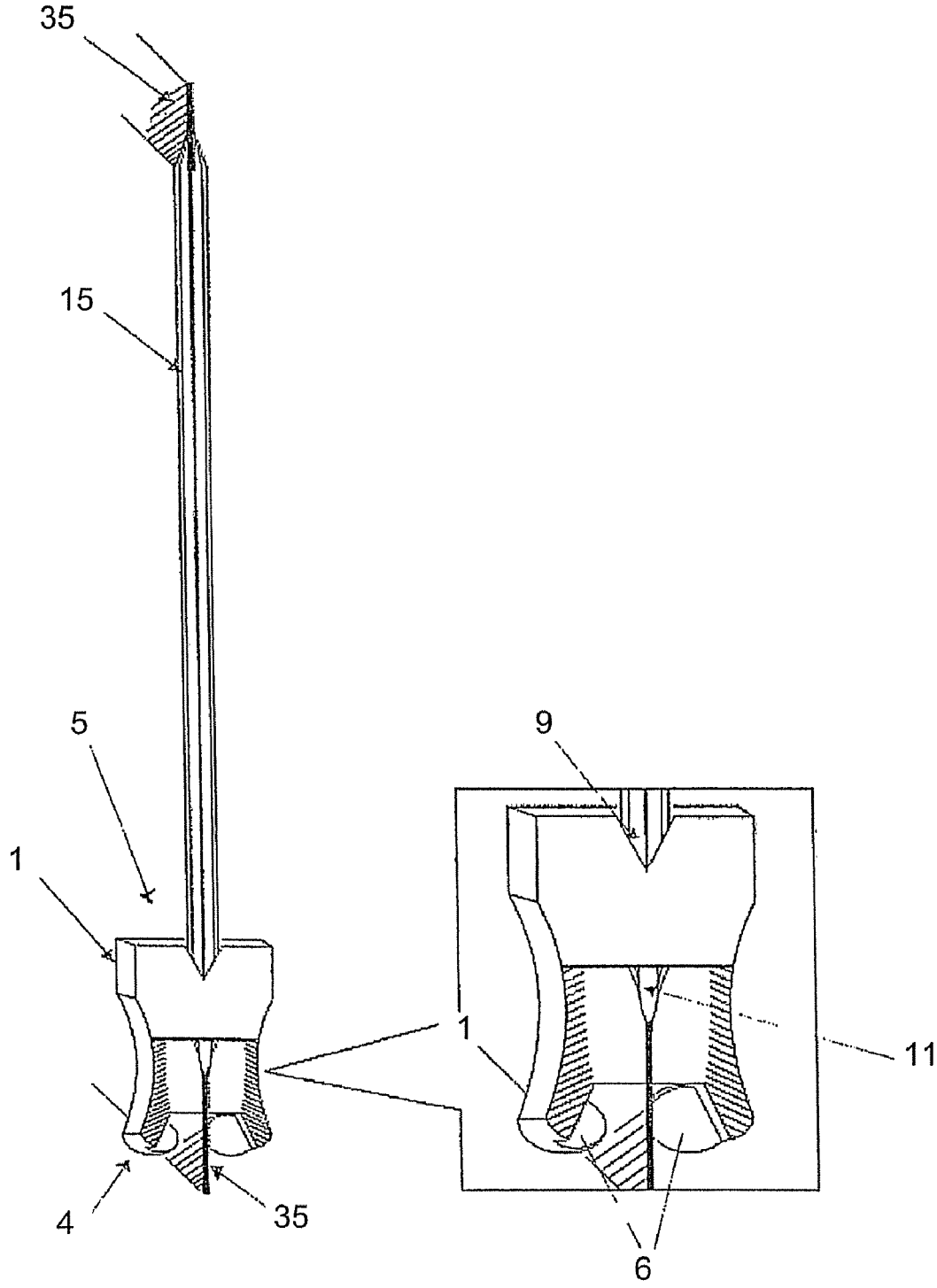
FIG. 16 illustrates the position of the plow or central notch when the slider in accordance with this invention is at its closing home position.

With reference now to FIG. 15, the slider (1) in accordance with the invention is shown at its closing home position. The bag has its ends sealed (35) as shown. At the closing home position, the leading edge (4) of the slider comes in contact with the end seal (35) and also partially overlaps it. The opening plow (11) is also pressed against the end seal (35). As shown the shorter edge (11*b*) of the opening plow is above the end seal and the longer edge (11*a*) is penetrating the upper pair of inter-locking members (22) of the zipper (15). The slanting edge of the opening plow thus completely seals the edge and eliminates the escape gaps that were formed with the sliders of the prior art. In addition to this, as shown in FIG. 16, leading edge (4) of the slider with its bottom protrusions (6) closes the lower pair of inter-locking members (23) at the edge near the end seal (35).

Therefore, though the opening plow (11) keeps the upper pair of inter-locking members (22) open at the edge of the end seal (35,30), the protrusions (6) keep the lower pair of inter-locking members (23) below the opened upper pair sealed.

Thus, the zipper when closed, is completely sealed along the bottom pair of inter-locking members (23) providing a leak proof and drip free re-closable flexible pouch, and the upper pair of interlocking members (22) are sealed throughout except at the end closing position, where the opening plow (11) penetrates the inter-locking members (22). The sloped edge of the opening plow (11) ensures that there is no gap between the opening plow and the end seal (35). This again ensures a drip free and leak proof re-closable pouch at the upper pair of inter-locking members also.

It will readily be appreciated by those skilled in the art that the present invention is not limited to the specific embodiments herein shown. Thus variations may be made within the scope and spirit of the accompanying claims without sacrificing the principal advantages of the invention.

I claim:

1. A re-closable flexible package comprising:

a pair of side panels joined along a first side edge and a second side edge, the panels defining a mouth providing access to a package interior;

a zipper closure having two sides positioned along the mouth of the package for selectively opening and closing the package mouth, the zipper closure including a first pair of inter-locking members on the two sides of the zipper closure and a second pair of inter-locking members on the two sides of the zipper closure disposed below the first pair of inter-locking members; and a slider having a leading edge and a trailing edge configured to open and close the zipper closure, the slider having a first pair of protrusions at a bottom of the leading edge, a second pair of protrusions at the trailing edge, and an opening plough protruding downward from a top surface of the slider between the leading edge and trailing edge, the opening plough having a height not more than a height of the slider such that the opening plough penetrates only the first pair of inter-locking members of the zipper closure, the opening plough having a sloped bottom surface such that a leading edge side of the opening plough has a height less than a height of a trailing edge side of the opening plough, the leading edge side of the opening plough remains above the first pair of inter-locking members when the slider is near one of the first side edge and the second side edge of the pair of side panels and the zipper closure is in a closed configuration.

2. A re-closable flexible package as claimed in claim 1 wherein the zipper closure has an external projection to lock the slider on to the zipper closure.

3. A re-closable flexible package as claimed in claim 1 wherein an edge seal of the package at the junction of the zipper closure and package is grooved.

4. A re-closable flexible package as claimed in claim 1 wherein a first open area is formed between a top surface of the slider and the first pair of protrusions.

5. A re-closable flexible package as claimed in claim 1 wherein an open area is formed between a top surface of the slider and the second pair of protrusions.

6. A re-closable flexible package as claimed in claim 4 wherein a second open area is formed between the top surface of the slider and the second pair of protrusions, the first open area being larger than a the second open area.

7. A re-closable flexible package as claimed in claim 1 wherein the slider has a grooved surface configured to be grasped by a user.

8. A re-closable flexible package as claimed in claim 1 wherein a first gap is formed between the first pair of protrusions such that the two sides of the zipper closure passing though the protrusions are sealed.

9. A re-closable flexible package as claimed in claim 8 wherein a second gap is formed between the second pair of protrusions such that the two sides of the zipper closure passing though the protrusions are sealed.

10. A re-closable flexible package as claimed in claim 9 wherein the first gap and second gap are substantially the same dimensions.

11. A re-closable flexible package as claimed in claim 1 wherein the opening plough has a trapezoidal profile.

* * * * *